US006911059B2

(12) United States Patent
Geyer

(10) Patent No.: US 6,911,059 B2
(45) Date of Patent: Jun. 28, 2005

(54) ABRASIVE PAD AND PROCESS FOR THE WET-CHEMICAL GRINDING OF A SUBSTRATE SURFACE

(75) Inventor: Stefan Geyer, Dresden (DE)

(73) Assignee: Infineon Technologies AG, Munich (DE)

( * ) Notice: Subject to any disclaimer, the term of this patent is extended or adjusted under 35 U.S.C. 154(b) by 24 days.

(21) Appl. No.: 10/723,630

(22) Filed: Nov. 26, 2003

(65) Prior Publication Data

US 2004/0116054 A1 Jun. 17, 2004

(30) Foreign Application Priority Data

Nov. 28, 2002 (DE) ..... 102 55 652

(51) Int. Cl.[7] ..... B24B 5/00; B24B 29/00; B24D 11/00; B24D 13/00; C08K 3/22

(52) U.S. Cl. ..... 51/298; 51/307; 51/308; 51/309; 451/28; 451/59; 451/526; 451/538

(58) Field of Search ..... 51/295, 293, 307, 51/308, 309, 298; 451/28, 59, 526, 490, 538; 15/244.1

(56) References Cited

U.S. PATENT DOCUMENTS

| | | | | |
|---|---|---|---|---|
| 5,624,303 A | * | 4/1997 | Robinson | 451/285 |
| 2003/0213500 A1 | * | 11/2003 | Mangin et al. | 134/6 |
| 2004/0055223 A1 | * | 3/2004 | Ono et al. | 51/293 |
| 2004/0118051 A1 | * | 6/2004 | Shiho et al. | 51/295 |

FOREIGN PATENT DOCUMENTS

| | | |
|---|---|---|
| DE | 697 13 057 T2 | 11/1998 |
| EP | 0 876 242 B1 | 11/1998 |
| JP | 2002086346 A | 3/2002 |

* cited by examiner

*Primary Examiner*—Michael Marcheschi
(74) *Attorney, Agent, or Firm*—Laurence A. Greenberg; Werner H. Stemer; Ralph E. Locher

(57) ABSTRACT

An abrasive pad is suitable for the wet-chemical grinding of a substrate surface. The novel abrasive pad has a polymer matrix with a defined water-solubility. The water-solubility is realized by the level of nonpolar and polar repeat units in the polymers.

11 Claims, 2 Drawing Sheets

ABRASIVE PAD AND PROCESS FOR THE WET-CHEMICAL GRINDING OF A SUBSTRATE SURFACE

BACKGROUND OF THE INVENTION

1. Field of the Invention

The invention relates to an abrasive pad and to a process for the abrasive machining of surfaces, in particular of semiconductor wafers, having a polymer matrix of a defined water-solubility.

Processes for the abrasive machining of surfaces are in widespread use, for example in the production of electronic memory elements. Elements of this type are generally constructed in layers from different materials. A build-up or patterning step, which may consist, for example, in an etching, sputtering or oxide deposition step, very often has to be followed by a planarization step, since the layer structure does not generally satisfy the highly accurate surface demands which are required or reproduces the topography of a wiring plane lying at a lower level even though the intention is actually to produce a planar surface. Chemical mechanical polishing (CMP) has gained widespread acceptance for planarization.

In CMP, surface regions lying at higher levels are accurately removed, in a manner which is as topography-selective as possible, by the interaction of liquid chemicals and abrasive bodies moving on the surface, such as for example polishing grains which can move freely or are fixed in a polishing cloth. Often, further material has to be removed after the planarization, the intention being, for example, for the removal of material to take place uniformly over the entire surface. In some applications, material-specific removal is also desired. In that case, a distinction is drawn between higher regions of a lower layer which have been uncovered by the CMP step and the planarized layer lying at the top.

The CMP process is relatively unsuitable for both forms of further removal of material. Although the CMP process is highly topography-selective and is therefore eminently suitable for planarization steps, the process is frequently inefficient for the large-area, uniform removal of material from a surface which has already been planarized. It may even be disadvantageous in particular for material-specific removal, since at least the mechanical component of the CMP attacks all surface materials treated. In both cases, therefore, purely chemical etching steps are recommended, such as for example the technique known as etchback, wherein the surface which is to be machined is exposed to a suitable liquid composition of chemicals.

In mass production of electronic chips, in particular the CMP step is generally carried out batchwise, i.e. with simultaneous machining of a plurality of wafers. This leads to a very considerable time saving and therefore cost saving. Suitable multichamber and multihead installations are increasingly being used. Modern installations are designed in such a way that fluctuations in the rates at which material is removed between the different heads or chambers are very slight. However, these fluctuations, together with those of previous machining steps, such as for example trench etching or oxide deposition, may cumulatively amount to an order of magnitude which can no longer be reconciled with the evermore demanding tolerance requirements which result from the increasingly fine structures of the chips.

Therefore, in many cases installations wherein a measuring arrangement which is used to determine the fluctuations within a batch by measuring the layer thickness of each individual wafer is provided in the CMP area are in widespread use. The measurement results are used as a quality criterion to decide upon any remachining or, if appropriate, the particular use of the batch or individual wafers. However, as the tolerances are reduced, the scrap levels increase to an economically unacceptable degree.

A range of different configurations of the CMP processes used are known, a distinction substantially being drawn between four fundamental processes:

a. the conventional CMP process;

b. the fixed abrasive CMP process;

c. the electrochemical-mechanical deposition process;

d. the abrasive-free slurry process.

In practice, the latter two processes are only relevant to the CMP processing of surfaces containing copper as conductive material and furthermore are still in the development stage. In contrast, the first two processes mentioned, i.e. the conventional CMP process and the fixed abrasive CMP process, are of general importance in particular for the processing of polysilicon oxide layers, tungsten and copper layers, wherein context the conventional CMP process is almost exclusively used, on account of the drawbacks of the fixed-abrasive CMP process.

When fabricating highly integrated circuits, the conventional chemical mechanical polishing (CMP) is in widespread use for the planarization of dielectrics or for the indirect patterning of wiring planes, i.e. for the removal of elevated regions of a patterned surface.

In the case of the conventional CMP process, a liquid which is mixed with polishing grains, preferably of a high hardness, and in some cases contains basic chemicals, known as the "slurry solution", is introduced between that surface of a semiconductor wafer which is to be machined and a polishing pad.

The pad and the surface which is to be machined are in surface contact with one another and are moved relative to one another, so that the surface which is to be machined is abraded by the polishing grains moving between the two surfaces.

A topography selectivity is desired for efficient planarization of non-uniformly patterned surfaces. This means that more material should be removed from elevated regions than from regions lying at a lower level. In the case of chemical mechanical polishing, this cannot be ensured under all circumstances, in particular in the event of large and very small structures occurring together.

The polishing grains which move with the slurry solution can also penetrate into the lower-lying regions of the surface for material-removal purposes, so that overall complete planarization requires a greater amount of material to be removed than merely the layer thickness of the elevated structures.

In recent times, better results have been achieved by the process known as "fixed abrasive" CMP, wherein the polishing pad is covered with a polishing means, for example a polishing cloth, wherein the polishing grains are fixed in a polishing grain carrier and only project beyond the surface of the latter in certain regions. In the case of the fixed abrasive CMP, the polishing means and the surface which is to be machined are brought into contact with one another and are set in motion relative to one another. Depending on the specific device used, this can be effected by moving just one surface or both surfaces. In addition, if necessary it is possible to add suitable liquid chemicals in order to remove material by chemical means at the same time as by mechanical means. Since the polishing grains only interact with the surface that is to be machined at the actual points of contact between the polishing means and the surface which is to be machined, it is possible to achieve a particularly high level of topography selectivity by way of fixed abrasive CMP.

Strictly speaking, in a purely mechanical sense, the fixed abrasive CMP process is actually a grinding process rather than a polishing process, since the grinding or polishing grains cannot move freely, but rather are fixed in an unordered fashion in a carrier and in particular at the surface of the latter. Nevertheless, the term "polishing" has gained acceptance in general everyday usage and consequently it will continue to be used in this context.

It is inevitable that a number, in some cases a considerable number, of polishing grains will become detached from the carrier during the machining operation, depending on the type of wafer and/or polishing means, so that, on the one hand, a "true" polishing process also always takes place and, on the other hand, the polishing means becomes blunt or aggressive over the course of time, with the result that the amount of material removed per unit machining time drops or increases.

This effect is extremely undesirable in mass production, wherein a large number of wafers are successively subjected to the same CMP working step, since the same presettable parameters of a working step, such as for example machining time, chemicals selected, etc. would lead to different results depending on the degree of wear to the polishing means. Fluctuations of this nature cannot be tolerated in particular as the structures become ever smaller.

A phenomenon which has a similar result also occurs in the conventional CMP process explained above. However, the processes which lead to the blunting effect are different. In the conventional CMP process, the surface of the pad, which is actually elastic, "vitrifies", i.e. the pores of the pad become blocked with relatively small polishing grains and in particular with material which has been removed from the surface that is to be machined. This leads to a hard and planar pad surface, with the result that significantly altered material-removal rates are produced. This discovery has generally been combated by cleaning and roughening the pad surface with the aid of a diamond needle. However, the process is too inaccurate for the fixed abrasive method and would cause the substantially pore-free polishing grain carrier to be destroyed, and consequently it is not suitable for use therein.

Therefore, that problem is currently attacked by exchanging the polishing means in steps, in each case before a new wafer is machined. Therefore, certain CMP devices offer automatic polishing-means advance ("roll-to-roll polisher"). However, equipment of this nature is expensive in two respects. Firstly, a device of this type requires considerable mechanical outlay. Secondly, it leads to excessive consumption of polishing means, giving rise to further costs. The polishing cloth which is customarily used has to satisfy extremely high accuracy demands with regard to its mechanical properties and with regard to the number, size and uniformity of the polishing grains, especially on account of the extremely small size of the structures which are to be machined. It is therefore complex and correspondingly expensive to produce.

However, the conventional CMP process has a range of drawbacks, such as for example what is known as the dishing effect, i.e. the undesirable recessing of surface structures, the relatively high consumption of slurry solution and the handling of the slurry solutions which are to be used. For example, the slurry solution has to be moved at regular intervals in order to achieve a uniform distribution of the suspended particles and to prevent the abrasive particles from settling. The abrasive particles used often have a mean diameter of 100 nm with a range from 40 to 200 nm, and consequently these particles have to be considered as macroscopic systems which are exposed in particular to the force of gravity and cannot be kept suspended by pure diffusion like microscopic particles.

Furthermore, in the case of existing slurry dispersions, the different interfacial properties of abrasive particles and slurry solution can lead to phase separation at excessively low temperatures, so that the slurry dispersion becomes unsuitable for use.

Certain drawbacks also have to be accepted in the fixed abrasive CMP process. For example, completely new equipment is required compared to the conventional CMP process. Furthermore, the fixed abrasive CMP process leads to high fluctuations in the material-removal rate, leading to an inhomogeneous surface treatment.

SUMMARY OF THE INVENTION

It is accordingly an object of the invention to provide an abrasive pad and a process for the abrasive machining of surfaces, specifically by wet chemical polishing, which overcomes the above-mentioned disadvantages of the heretofore-known devices and methods of this general type and which provides for a CMP process wherein no dishing effect occurs and also there are no fluctuations in the material-removal rate. Furthermore, the consumption of consumables, in particular of the slurry solution used and abrasive particles, should be as low as possible. Moreover, it is desirable for it to be possible for the slurry solution which is to be used to be employed without extensive preparation and for it to be suitable for storage over prolonged periods of time without the quality of the slurry solution being adversely affected.

Furthermore, it should be possible for tried-and-tested CMP installations which are already in use to continue to be used after a small amount of changeover work.

With the foregoing and other objects in view there is provided, in accordance with the invention, an abrasive pad for the wet-chemical grinding of a substrate surface. The pad comprises a polymer matrix having polymers with repeat units, and a water-solubility of 0.03 to 3 g/l; and abrasive particles embedded in the polymer matrix.

The advantages of the abrasive pad according to the invention are that the defined water-solubility and a relatively rigid polymer matrix mean that dishing of surface structures does not occur, and therefore the surfaces are smoothed in a manner which is much more gentle on the sensitive structures.

With regard to the water-solubility of the polymer matrix, extremes, i.e. extensive water-solubility or water insolubility, should be avoided. If the water-solubility of the polymer matrix is too low, the substrates are ground to an excessive degree, possibly leading to destruction of fine surface structures. On the other hand, if the water-solubility is too high, the grinding effect is insufficient, and consequently the polishing process takes up a relatively long time. Moreover, in this case the consumption of consumables, such as slurry solution and polymer matrix, is very high and therefore uneconomical.

The water-solubility of the polymer matrix is to be optimized so that both sufficient release of abrasive particles is ensured, in order to guarantee an effective polishing process, and the material-removal rate from the abrasive pad should be kept as low as possible, so that the consumption of consumables is minimized. In this case, the water-solubility is set by means of the proportions of water-soluble and water-insoluble monomer units from which the polymer matrix is built up.

The constant release of abrasive particles also minimizes the fluctuations in the material-removal rate, since only the quantity of abrasive particles which is actually required is available for the polishing process. Excesses and deficits of abrasive material, as occur in conventional processes, are avoided. This makes a further contribution to a surface treatment which is as gentle and uniform as possible.

Since the abrasive particles are made available by the abrasive pad, it is only necessary to provide the actual slurry solution, without the abrasive particles which are normally contained therein. This, on the one hand, reduces the consumption of slurry solution required, since the addition of the solution can be limited accurately as a function of the material-removal rate, and, on the other hand, also reduces the consumption of abrasive particles, since the defined material-removal rate means that only the number of abrasive particles which are required to carry out the polishing process are released.

Furthermore, there is no risk of insoluble particles settling as a sediment or of phase separation occurring at relatively low temperatures in the event of prolonged storage, which has previously greatly restricted the usability of the slurry solution.

In the most simple case, water, to which a number of additives may have been admixed if required, can be used as slurry solution. To ensure that the pH of the slurry solution is stable, it is appropriate to add pH regulators, such as for example buffer systems. The pH range to be selected for the slurry solution results as a function of the surface material which is to be polished.

For example, in the case of silicon-containing surfaces, an alkaline pH from 10 to 11 should be selected, whereas a more acidic pH of approximately 2 is recommended for tungsten-containing surfaces.

The buffer system to be used is in this case determined from the pH range which is to be stabilized. For example, buffers based on hydrogen carbonate and/or hydrogen phosphate are used in the alkaline range, whereas, for example, a dihydrogen phosphate or a hydrogen phthalate buffer can be used at acidic pHs.

Handling of the slurry solution is greatly simplified by virtue of the fact that the slurry solution is a true solution and there is no need to produce demanding mixtures of an actual slurry solution and abrasive particles. Therefore, the preparation of the slurry solution is restricted to setting the desired pH and the oxidation capacity by the addition of suitable buffer systems and oxidizing agents.

The polymer matrix itself should be substantially pH-independent and in particular also should not influence the pH of the solution, i.e. should not include any acidic or basic groups. If a pH-labile compound, such as for example polyacrylic acid, were to be used as starting material for the polymer matrix, decomposition phenomena may occur during the polishing process, which would have an adverse effect on the condition and material quality of the polymer matrix.

The use of a 0.1% strength $Na_2CO_3$ solution as buffer system has proven suitable for the polishing of wafer substrates based on silicon.

Furthermore, it is additionally possible for oxidizing agents, such as for example iron(III) nitrate, to be added in order to assist the polishing process. In this context, a 0.5% strength $Fe(NO_3)_3$ solution has proven suitable. The oxidizing agents are responsible for oxidizing the metallic or semi-metallic surface atoms, so that the solubility is increased and the polishing process can take place more quickly.

The abrasive particles which are responsible for the actual polishing process are only released to the degree required to reliably ensure that the polishing process takes place, whereas in conventional CMP processes there is often an excess or a deficit of these particles. In this way, the consumption of abrasive materials is restricted to the level required.

The abrasive pad according to the invention can be introduced into existing installations without major outlay, meaning that only low changeover and maintenance costs are incurred.

Since the abrasive pad according to the invention replaces the conventional classic abrasive pad, firstly a further abrasive pad material is no longer required, and secondly the often complex preparation of the conventional abrasive pad, such as for example the production of a defined surface structure by roughening processes, can be dispensed with.

The polymers which include repeat units may be organic or inorganic polymers. On account of the use of a combination-rich organic synthesis chemistry, organic polymers have a wide range of forms, so that the polymer matrix can be matched to a very wide range of ambient conditions.

By contrast, inorganic polymers, such as for example systems based on silicon, have the advantage of a generally higher chemical resistance, although the structural possibilities are limited compared to organic systems.

By contrast, however, with inorganic compounds the restriction to the small number of typical "organic" elements, such as carbon, hydrogen, oxygen, nitrogen, sulfur and phosphorus, disappears, so that in principle it is possible to employ up to 100 different elements and to realize a very wide range of properties.

It is preferable for the water-solubility of the polymer matrix to be determined by the hydrophilicity of the repeat units. The water-solubility of the polymer matrix formed from the polymers can be determined directly from building blocks of the polymers formed therefrom. Moreover, the repeat units are from a chemical standpoint a relatively simple and readily controllable system, and unlike individual polymers or even polymer blends can be changed in a defined and targeted manner.

The water-solubility of the polymer matrix is appropriately determined by repeat units which each have conflicting water-solubilities. The combination of water-soluble and water-insoluble repeat units makes it possible to synthesize copolymers with a defined water-solubility.

With fixed repeat units, the water-solubility can be controlled both by means of the fraction of the water-soluble and/or water-insoluble repeat units and by means of the local distribution within the polymer. In the former case, copolymers with a random distribution of the repeat units are obtained, whereas the second option leads to a water-soluble/water-insoluble homopolymer with water-insoluble/water/soluble end groups.

The degree of polymerization of the polymers obtained should not exceed 10,000, and the molar mass should be in a range between 3000 and 200,000. With lower molar masses, the consistency of the polymer matrix is too soft and the amount of material removed during the polishing process is very high. This greatly restricts the ability of the abrasive pad to function. On the other hand, an excessively high molar mass of over 200,000 inevitably causes the hydrophilic or hydrophobic properties introduced by the functionality of the repeat units to be masked, and the water-solubility of the polymer matrix is difficult to control.

However, varying the molar masses offers the option of deliberately adjusting the melting point of the polymer matrix and thereby adapting it to the external process conditions. In the case of mechanical polishing processes, a high level of frictional heat is generally released, and this cannot readily be dissipated straightaway, thereby leading to local heating of the substrate and abrasive pad surfaces. This heating has a considerable influence on the mechanical properties, such as hardness and volume, of the bodies affected. This can be influenced and counteracted by suitable selection of the molar masses of the polymers involved in the polymer matrix.

Since crosslinked polymers tend to exhibit swelling phenomena, thereby endangering the mechanical stability of the polymer matrix, linear systems are preferred. Also, in the event of swelling unpredictable changes to the volume occur, and consequently the precise distance which is to be maintained between abrasive pad and substrate surface can no longer be controlled and it is impossible to rule out the possibility of the surface being destroyed by compressive forces which occur.

In this context, it is advantageous if the hydrophilicity of the repeat units is determined by polar or nonpolar groups attached to the repeat units. Groups which are attached to the repeat units can be adapted to external conditions more easily and in a less complicated way than the basic frameworks of the repeat units.

The attached groups are often located at the outer regions of the repeat units and are therefore readily accessible to chemical agents.

Although the properties of the groups attached to the repeat units may also be suitable for the hydrophilicity of the resulting polymer or polymer matrix, they may be disadvantageous for the synthesis of the polymer. For example, polyvinyl alcohol is formed by polymerization of vinyl acetate and subsequent saponification, and not by polymerization of vinyl alcohol, since the acetate monomer, on account of the electron-withdrawing effect of the carbonyl group, results in an attenuated electron density of the carbon-carbon double bond and therefore a higher reactivity compared to the vinyl alcohol monomer.

Nevertheless, on account of its pronounced hydrophilic character, the hydroxyl group is desirable in the resulting polymer, and consequently it is necessary to separate off the acetate group by saponification so as to form the alcohol.

It is particularly advantageous if the repeat units are derived from a nonpolar or polar monomer unit. The hydrophilicity and water-solubility of the polymer matrix are directly determined by the hydrophilic properties of the repeat units and of the polymers formed therefrom.

The most simple way of determining the hydrophilicity of the repeat units and therefore of the polymer matrix consists in using nonpolar or polar monomer units as the original repeat units.

A wide range of these monomer units are obtainable, each with a water-solubility which is well known or can readily be ascertained, and these monomer units allow targeted and defined synthesis of polymers whose properties in terms of the water-solubility may be derived from the structure.

Examples of possible polar monomer units which may be used include vinyl alcohol, acrylic acid, ethyleneimine or ethylene oxide. Examples of suitable nonpolar monomer units are propylene, ethylene, α-methylstyrene and vinyl chloride.

These monomer units are commercially available in large quantities and at low cost and are sufficiently reactive to ensure rapid polymerization. Furthermore, the hydrophilic/hydrophobic properties of these monomer units are sufficiently pronounced.

It is preferable for the nonpolar monomer unit to be styrene and the polar monomer unit to be vinyl-pyrrolidone. Both monomer units are commercially available at low cost and on a large scale and are sufficiently reactive. Apart from minor irritation symptoms, the two monomers are not known to have any short-term or long-term toxic effects, meaning that these monomer units present relatively few handling problems and do not require any special safety precautions.

The nonpolar or polar properties are greatly emphasized by the aromatic benzene ring in the case of styrene or the pyrrolidone ring, so that, by suitably selecting the division of monomers, it is possible to realize a very wide spectrum, from purely hydrophilic properties, when using exclusively vinylpyrrolidone, through hydrophobic properties, when using exclusively styrene.

Furthermore, both styrene and vinylpyrrolidone are distinguished by a high chemical stability, making it easier to store them for prolonged periods of time and meaning that the polymers synthesized therefrom also have positive effects in terms of the chemical stability. Furthermore, vinylpyrrolidone is substantially inert with respect to the pH of the slurry solution, and consequently there are no restrictions in this respect.

The problems of inadequate stability with respect to variable pHs of the slurry solution or direct influencing of the acidity of this solution by attached acidic and/or basic functional groups, which are often encountered with polar monomer units, do not arise with vinylpyrrolidone. This monomer unit has proven sufficiently inert with respect to pHs which deviate from neutral conditions and moreover does not have any pronounced effect on the existing pH of the solution.

This fact facilitates the selection of a suitable pH, which is to be determined as a function of the material which is to be polished, without it being necessary to take into account the influence of the polymer matrix or possible decomposition of this matrix.

In a preferred embodiment of the abrasive pad according to the invention, the abrasive particles contain one or more oxides which are selected from the group consisting of aluminum oxide, silicon oxide and cerium oxide.

On account of their structure, these oxides have a sufficiently high hardness for polishing of the substrate surface and are available at low cost. They are obtained either simply from the starting metals by oxidation or by breaking down the form wherein they are naturally found. For example, aluminum oxide is available in large quantities as corundum, and silicon dioxide is available in large quantities as silica sand.

In addition to the abrasive pad according to the invention, the present invention also relates to a device for the chemical mechanical polishing of a wafer surface using an abrasive pad as described above.

Particularly in semiconductor technology, there is a high demand for wafer substrates with an extremely homogeneous surface, which are produced by chemical mechanical polishing. The abrasive pad according to the invention is eminently suitable for a chemical mechanical polishing process of this type. It is possible to continue to use the existing installations, meaning that expensive conversion work is not required and the advantages of the abrasive pad according to the invention can be exploited immediately.

The abrasive pad according to the invention can advantageously be used in all processes wherein wafer and other substrate surfaces are to be smoothed.

Furthermore, the invention relates to a process for the wet-chemical grinding of a substrate surface wherein the abrasive pad according to the invention is used.

Other features which are considered as characteristic for the invention are set forth in the appended claims.

Although the invention is illustrated and described herein as embodied in an abrasive pad and a process for the wet-chemical grinding of a substrate surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
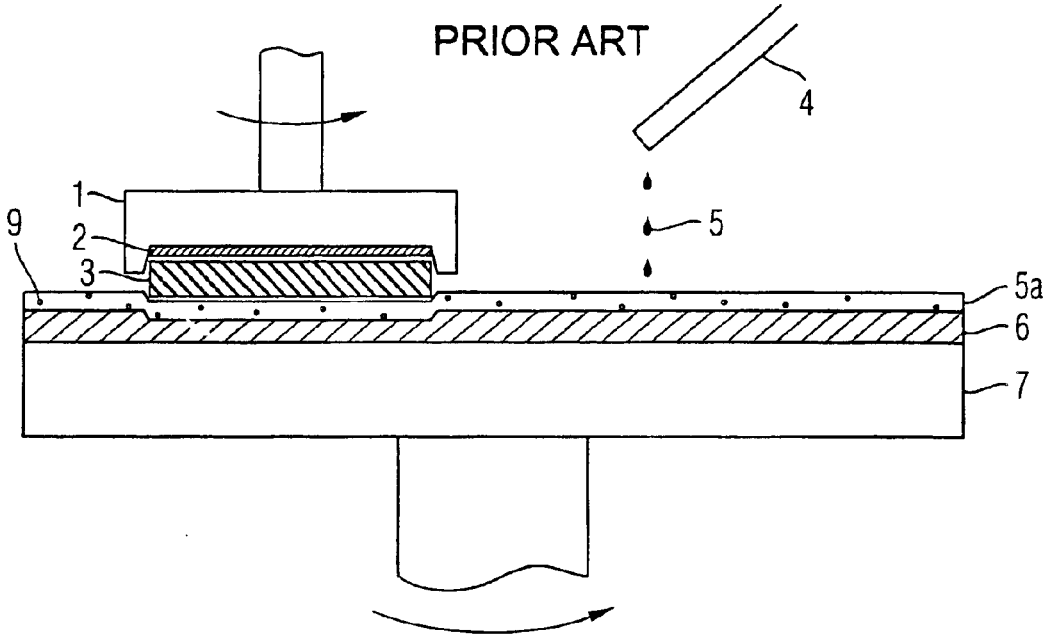
FIG 1 PRIOR ART
FIG. 1 is a side elevational view of a conventional chemical mechanical polishing device.

Referring now to the figures of the drawing in detail and first, particularly, to FIG. 1 thereof, there is shown a conventional device for the chemical mechanical polishing of a substrate 3, such as a silicon wafer, and its conventional use. A conventional abrasive pad 6 has been placed on a rotating polishing table 7. The abrasive pad 6 generally comprises a roughened, leather-like foamed leather or a thin rubber-like plastic with a thickness of approximately 1.5 to 2 mm. The slurry solution 5 is applied dropwise to the abrasive pad 6 via a slurry feed 4. On account of the roughened surface of the abrasive pad 6 and the hydrophilic property of this surface, and boosted by the centrifugal forces which are active on account of the rapid rotation of the polishing table 7, a substantially homogeneous slurry film 5*a* is formed on the abrasive pad 6. The substrate holder 1 presses the substrate 3 lightly onto the conventional abrasive pad 6, with the slurry film 5*a* remaining in place between substrate 3 and the conventional abrasive pad 6. The mechanical loading and the elasticity of the conventional abrasive pad 6 causes an imprint of the substrate 3 to form on the conventional abrasive pad 6.

The slurry solution 5 substantially comprises water and abrasive particles 9 with a diameter of between 50 and 200 nm. Materials used for the abrasive particles 9 are generally hard, stable metal oxides, such as aluminum oxide, silicon oxide, or cerium oxide. In addition, the slurry solution often contains pH-stabilizing buffer system and oxidizing agents.

The abrasive particles 9 have a greater hardness than the substrate 3 and, on account of the mechanical rotary motion of polishing table 7 and the substrate holder 1, they abrade material from the surface of the substrate 3. This leads to a corresponding smoothing of the surface of the substrate 3.

Furthermore, the rotary motion of the polishing table 7 and the substrate holder 1 serves both to intimately mix the slurry solution 5 which is present on the abrasive pad 6 and to constantly renew the regions of abrasive pad 6 and substrate 3 which face one another, so that the action of possible irregularities on the abrasive pad 6, with their corollary adverse effects on the polishing process, is suppressed.

The substrate 3 is held by a rotating substrate holder 1, with a holding pad 2 also located between the substrate holder 1 and the substrate 3. The holding pad 2 is used to absorb shocks and to protect the surface of the substrate 3 from being damaged by the substrate holder 1. The substrate holder 1 fixes the substrate 3 above the abrasive pad 6 in such a way that an orientation which is as accurately parallel as possible is ensured between the substrate 3 and the abrasive pad 6, with the surface of the substrate 3 lying completely opposite an outer region of the abrasive pad.

The greater the radial distance between the substrate and the axis of the rotating polishing table 7, the higher the actual velocity of the surface of the substrate 3 with respect to the abrasive pad 6 becomes and thereby the greater the polishing effect becomes.

If the orientation between the two parts is not precisely parallel, there will be a local mechanical overload on the substrate 3, which may lead to an uneven polishing effect on the surface of the substrate or even to the substrate 3 fracturing. A space has to remain between the substrate 3 and the abrasive pad 6, into which the slurry solution 5 can penetrate and can thereby remove material from the surface of the substrate 3. Furthermore, it is imperative to avoid direct contact between the substrate 3 and the abrasive pad 6, since this causes high mechanical loads to occur, producing defects on the surface of the substrate 3, which render the substrate 3 unsuitable for further processing.

Figure 2:
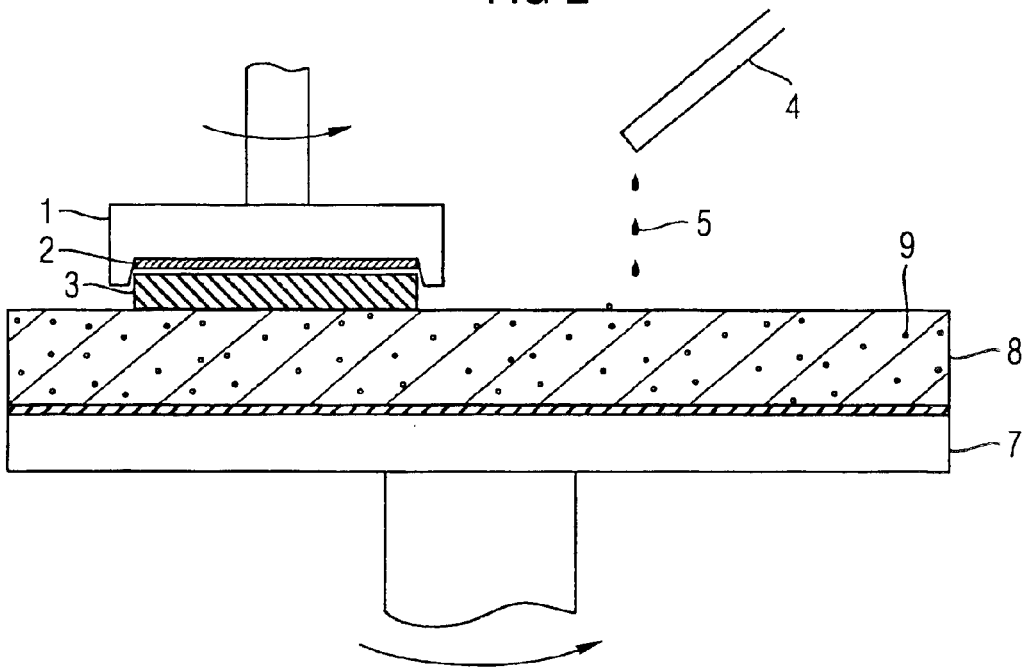
FIG. 2 is a similar view of a device for the chemical mechanical polishing of a wafer surface using the abrasive pad according to the invention.

FIG. 2 shows a similar chemical mechanical polishing device to that presented in FIG. 1, except that in this case the conventional abrasive pad 6 has been replaced by the abrasive pad 8 according to the invention. In the device according to the invention, the slurry solution 5 contains only water and soluble constituents, such as buffer system and oxidizing agents, but does not contain any abrasive particles 9. The abrasive particles 9 required for the polishing process are provided by the abrasive pad 8 according to the invention. The slurry solution 5 is applied dropwise to the abrasive pad 8 according to the invention via a slurry feed 4. The defined water-solubility of the polymer matrix 10 in conjunction with the mechanical load between substrate 3 and abrasive pad 8 brought about by the rotary movements of the polishing table 7 and the substrate holder 1 cause the polymer matrix 10 to be gradually dissolved, so that the abrasive particles 9 contained in the polymer matrix 10 are released, making them available for the polishing process.

The solubility of the polymer matrix is set, by means of the proportions of water-soluble and water-insoluble monomer units, in such a way that, on the one hand, sufficient abrasive particles 9 are released and, on the other hand, the abrasive pad 8 is not worn away too quickly. Unlike in the context of a conventional device, the substrate 3 can be brought into direct contact with the abrasive pad 8 without any risk of damage to the substrate 3. A certain degree of mechanical contact between the substrate and the abrasive pad is even necessary in order to produce the required abrasion from the abrasive pad 8 and thereby to liberate abrasive particles 9.

In the device according to the invention, the abrasive pad does not yield, unlike in the case of a conventional abrasive pad 6. This results in material being abraded exclusively horizontally, so that the effect of dishing of surface structures, which occurs with conventional devices, is avoided.

Figure 3:
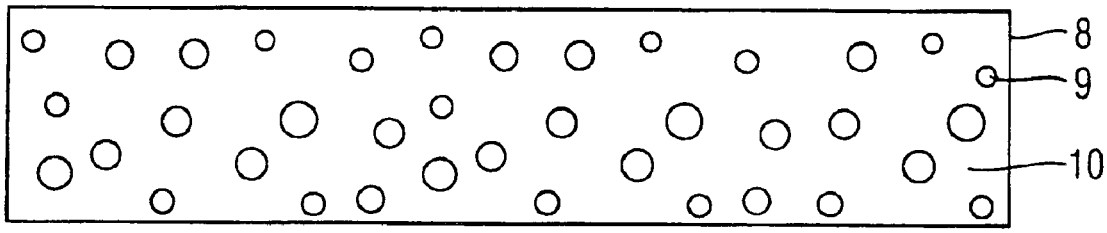
FIG. 3 is a diagrammatic view of the abrasive pad according to the invention.

FIG. 3 diagrammatically depicts the structure of the abrasive pad 8 according to the invention. The main constituent is a polymer matrix 10 with a defined water-solubility. The water-solubility of the polymer matrix 10 is determined by the proportion of water-soluble to water-insoluble monomer units. The abrasive particles 9 are embedded in the polymer matrix 10. During the polishing process, the abrasive particles 9 are gradually released by the slurry solution 5 as the polymer matrix 10 dissolves.

Figure 4:
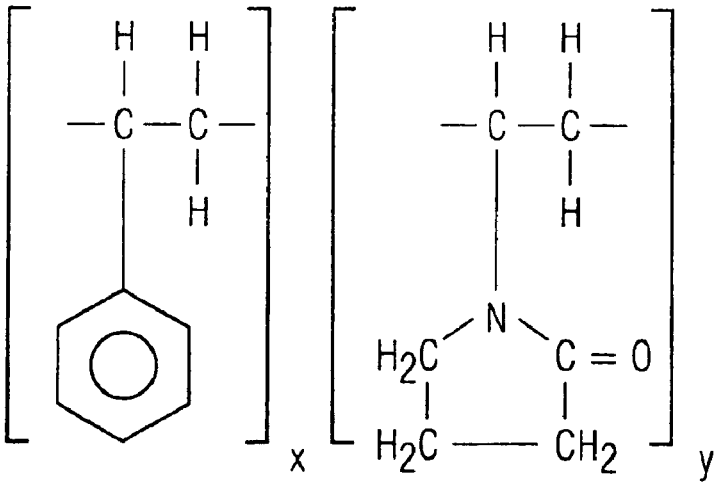
FIG. 4 is a structural formula of a styrene/vinylpyrrolidone copolymer.

FIG. 4 shows a structural representation of a polymer that can be used for the polymer matrix 10. Vinylpyrrolidone is used as water-soluble monomer unit, and styrene is used as water-insoluble monomer unit, so that a copolymer is obtained. By varying the styrene content (X) and/or the vinylpyrrolidone content (Y), it is possible to set the water-solubility of the resulting copolymer in a defined way.

The invention will now be explained in more detail on the basis of examples.

EXAMPLE 1

Laboratory Stage 10 g of pulverulent aluminum oxide (Aluminia Polishing Powder CR 85, Baikowski Chimie, Charlotte, N.C.) and 30 g of Marlipal 1618/25 (linear fatty alcohol ethoxylate with 16–18 carbon atoms in the fatty alcohol radical and 25 mol of ethylene oxide in the hydrophilic group/Sasol, SA) are added to a beaker with a capacity of 100 ml, and the mixture is then heated on a heating plate to a temperature of approximately 120° C. In the process, the Marlipal melts and the aluminum oxide powder is distributed uniformly in the molten Marlipal by stirring using a polytetrafluoroethylene-clad thermometer.

At the start of stirring, the aluminum oxide to some extent forms lumps, but the lumps disappear within a few minutes, and a completely homogeneous melt/mixture is formed.

Once a homogeneous mixture of abrasive and molten matrix has formed, this mixture is then poured into a small dish made from aluminum foil, is cooled to room temperature and solidified. Then, a fragment of-the solidified melt is removed and a piece of a wafer comprising 20 nm of undoped polysilicon (steel blue) over 175 nm of nitride produced using the low-pressure chemical vapor deposition (LPCVD) process (red-orange) over silicon as base material is polished manually under running water. It was found that, with the piece of the abrasive pad according to the invention, it is possible to abrade the 20 nm thick polysilicon layer off the silicon nitride without problems and without leaving any scratches. In the process, the steel-blue piece of wafer becomes red-orange on the ground area.

EXAMPLE 2

Production Stage

The standard polymer compounding technique is used to produce injectable granules from the abrasive powder, which is formed, for example, from aluminum oxide, silicon oxide or cerium oxide and the matrix substance (e.g. $C_{22}$–$C_{24}$ fatty alcohol polyethylene glycol ether-6EO or styrene/vinylpyrrolidone copolymer). Then, the standard plastic injection-molding technique is used to spray the mixture of abrasive and matrix formed from these injectable granules onto a round polypropylene carrier plate of the standard polishing table size to form a 20 mm high layer. The abrasive pad according to the invention which is thereby produced is used on the conventional CMP process installations as a replacement for the conventional abrasive pads. The polishing liquid used, as in the fixed abrasive CMP process, is an abrasive-free aqueous solution.

I claim:

1. An abrasive pad for the wet-chemical grinding of a substrate surface, comprising:

a polymer matrix having polymers with repeat units, and a water-solubility of 0.03 to 3 g/l; and abrasive particles embedded in said polymer matrix.

2. The abrasive pad according to claim 1, wherein said polymers with the repeat units are selected from the group consisting of organic and inorganic polymers.

3. The abrasive pad according to claim 1, wherein said polymer matrix has a water-solubility determined by a hydrophilicity of said repeat units.

4. The abrasive pad according to claim 3, wherein the hydrophilicity of said repeat units is determined by polar groups attached to said repeat units.

5. The abrasive pad according to claim 3, wherein the hydrophilicity of said repeat units is determined by nonpolar groups attached to said repeat units.

6. The abrasive pad according to claim 1, wherein the water-solubility of said polymer matrix is determined by a distribution of said repeat units.

7. The abrasive pad according to claim 1, wherein said repeat units are derived from a nonpolar or polar monomer unit.

8. The abrasive pad according to claim 7, wherein said nonpolar monomer unit is styrene and said polar monomer unit is vinylpyrrolidone.

9. The abrasive pad according to claim 1, wherein said abrasive particles include one or more oxides selected from the group consisting of aluminum oxide, silicon oxide, and cerium oxide.

10. A chemical mechanical polishing device, comprising:

a holder for a wafer; and an abrasive pad according to claim 1 movably disposed relative to said holder for chemical mechanical polishing of the wafer.

11. A process for the wet-chemical grinding of a substrate surface, which comprises polishing the substrate surface with the abrasive pad according to claim 1.

* * * * *